United States Patent [19]

DuFries

[11] Patent Number: 4,511,096

[45] Date of Patent: Apr. 16, 1985

[54] SPINNER DRIVE FOR DOUBLE BLOCK WIRE DRAWING MACHINE

[75] Inventor: Ronald W. DuFries, Westboro, Mass.

[73] Assignee: Morgan Construction Company, Worcester, Mass.

[21] Appl. No.: 551,332

[22] Filed: Nov. 14, 1983

[51] Int. Cl.[3] ..... B65H 51/20; B21C 1/14

[52] U.S. Cl. ..... 242/47.01; 72/289; 242/25 R; 242/47.12; 242/78

[58] Field of Search ..... 242/47.01, 47.12, 25 R, 242/82, 47, 78; 72/280, 287, 288, 289

[56] References Cited

U.S. PATENT DOCUMENTS

| | | | |
|---|---|---|---|
| 2,186,106 | 1/1940 | Hargreaves et al. | 242/25 R |
| 2,237,371 | 4/1941 | Simons | 72/289 |
| 2,669,347 | 2/1954 | McIlvried et al. | 242/78 X |
| 2,874,918 | 2/1959 | Steiber | 242/82 |
| 3,078,055 | 2/1963 | Harris | 242/47.12 |
| 3,241,780 | 3/1966 | Kitselman | 242/47.12 |
| 3,750,449 | 8/1973 | Rabe et al. | 72/288 |
| 4,036,448 | 7/1977 | Carey | 242/82 |
| 4,164,859 | 8/1979 | Steinhilber | 72/289 |

FOREIGN PATENT DOCUMENTS

| | | | |
|---|---|---|---|
| 2052768 | 5/1972 | Fed. Rep. of Germany | 72/289 |
| 2052767 | 11/1972 | Fed. Rep. of Germany | 72/289 |
| 2065180 | 11/1972 | Fed. Rep. of Germany | 72/289 |
| 6470 | 3/1969 | Japan | 72/289 |
| 687866 | 2/1953 | United Kingdom | 72/289 |
| 1025865 | 4/1966 | United Kingdom | 72/289 |

*Primary Examiner*—Stanley N. Gilreath

*Attorney, Agent, or Firm*—Maurice E. Gauthier

[57] ABSTRACT

In a wire drawing machine having at least one station with upper and lower blocks and an associated spinner carrying a transfer sheave, the blocks and spinner being rotatable relative to each other about a common axis defined by a drive shaft to which the lower block is drivingly connected, the improvement comprising controllably shifting the spinner axially on the drive shaft into and out of frictional contact with the lower block.

7 Claims, 2 Drawing Figures

SPINNER DRIVE FOR DOUBLE BLOCK WIRE DRAWING MACHINE

BACKGROUND OF THE INVENTION

1. Field of the Invention

This invention relates to an improvement in double-block cumulative multi-draft wire drawing machines.

2. Description of the Prior-Art

In wire drawing machines of the above-mentioned type, the wire is drawn through a succession of stations. Each station includes upper and lower blocks and a spinner carrying a transfer sheave. The blocks and spinner are rotatable relative to each other about a common axis. The lower block is driven to pull wire through a die, with the thus drawn wire then being accumulated temporarily as a plurality of windings on the lower block. The wire then passes from the lower block via the spinner-mounted transfer sheave to the upper block where it is again temporarily accumulated as a plurality of windings before leaving the station to either be passed through a subsequent die or to be finally accumulated on a spool as finished wire.

In order to control the tension of the wire passing between the lower and upper blocks, the spinner is driven, either by an externally contracting drive band which frictionally grips the lower block, or by a motor driving through a V-belt. The direction of rotation of the upper block is either opposite to that of the lower block, or non-existent, depending on whether the blocks are accumulating. The spinner may rotate in either direction, or it may remain motionless.

The rate of wire accumulation on the blocks varies according to the relative drafting practice between stations. While the spinner is motionless, the lower block is passing wire around the transfer sheave and onto the upper block as fast as the wire is coming onto the lower block, and the upper block is passing wire to the next station as fast as it is being received from the lower block. If the succeeding station requires more wire than is being supplied to the lower block, it will pull accumulated wire from the upper block, which in turn will pull accumulated wire from the lower block. However, only one-half the amount required will be pulled from the lower block's accumulation. The other half will be made up from the upper block's accumulation through rotation of the spinner. The wire accumulation is being decreased during this type of operation, with the spinner being rotatably driven in a direction opposite to that of the lower block.

When the succeeding station demands less wire than that being drawn into the lower block, there will be an excess of wire being passed from the lower block to the upper block. In this case, the spinner is rotatably driven in the same direction as that of the lower block, thereby causing one-half of the excess accumulation to go to the lower block and one-half to go to the upper block.

Although this type of machine operates in a generally satisfactory manner, difficulties have been experienced with the manner in which the spinners are driven. For example, the externally contracting drive bands can be adjusted only when the machine is stopped. Thus, tension control of the wire passing from the lower to the upper blocks is largely a matter of trial and error with each adjustment necessitating a machine shutdown. While the V-belt drive offers an improvement in this respect in that it can be adjusted to control tension while the machine is in operation, because the belt is located externally of the blocks, it is exposed to the path of wire movement and is frequently severed when a wire break occurs. Thus, both spinner driving systems are a source of problems.

SUMMARY OF THE PRESENT INVENTION

The present invention has as dual objectives the provision of a spinner drive which can be adjusted while the machine is in operation, and which is not susceptible to being damaged in the event of a wire break.

In a preferred embodiment of the invention to be described hereinafter in more detail, these objectives are achieved by providing means for controllably shifting the spinner axially into and out of frictional contact with the lower block, thereby imparting to the spinner the degree of frictional drive required for a particular operating condition.

Preferably, the spinner is yieldably urged away from the lower block by a separating means which conveniently may comprise a compression spring or other like resilient component, with the control means acting in opposition to the separating means to urge the spinner against the lower block.

Preferably, the control means will comprise an annular piston-cylinder assembly with appropriately arranged thrust bearings.

These and other objectives, features and advantages will be described hereinafter in more detail in connection with the accompanying drawings, wherein:

DESCRIPTION OF PREFERRED EMBODIMENT

Figure 1:
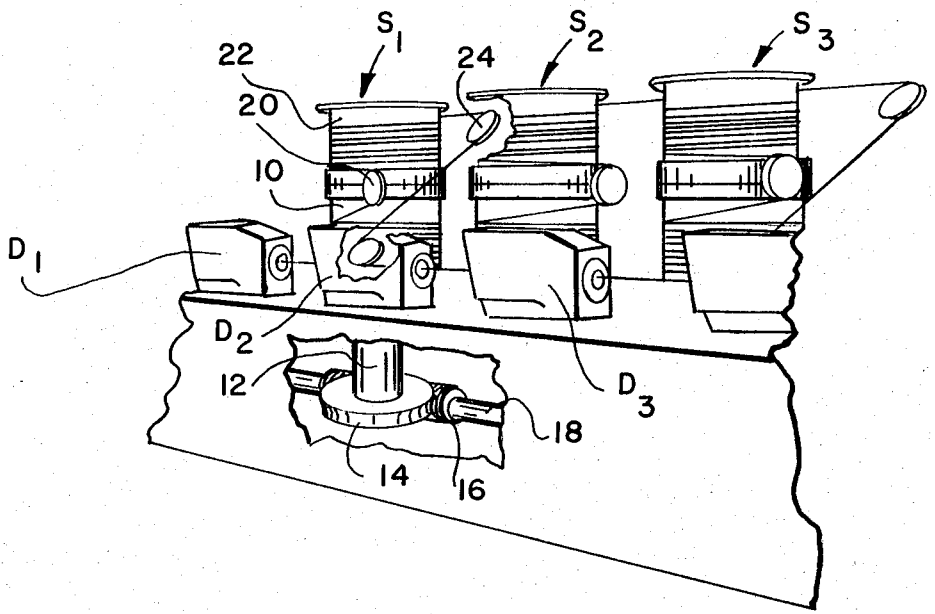
FIG. 1 is a partial perspective view, with portions broken away, of a wire drawing machine embodying the present invention.

Referring initially to FIG. 1, a portion of a typical double block cumulative multi-draft wire drawing machine is shown comprising successive stations $S_1$, $S_2$, and $S_3$. Each station operates to pull wire through a respective associated die $D_1$, $D_2$, and $D_3$. For example, and with reference to station $S_1$, wire is pulled through die $D_1$ onto a lower block 10 driven by a drive shaft 12. The shaft 12 carries a worm wheel 14 meshing with a worm gear 16 on a power shaft 18. The power shaft is driven in a conventional manner by a motor and gear box (not shown). The lower blocks of each station are driven through similar sets of worm wheels and worm gears by the same power shaft, with the gear ratios of each set being selected to accommodate the gradually increasing wire speed resulting from the successive drawing operations.

After being drawn through die $D_1$ the wire is temporarily accumulated as a plurality of windings on the lower driven block 10 before passing via a spinner-mounted transfer sheave 20 onto an upper block 22 where it again is temporarily accumulated as a plurality of windings before leaving the station by passing around another sheave 24 to the next die box $D_2$ which is associated with the succeeding station $S_2$ where the operation is again repeated.

Figure 2:
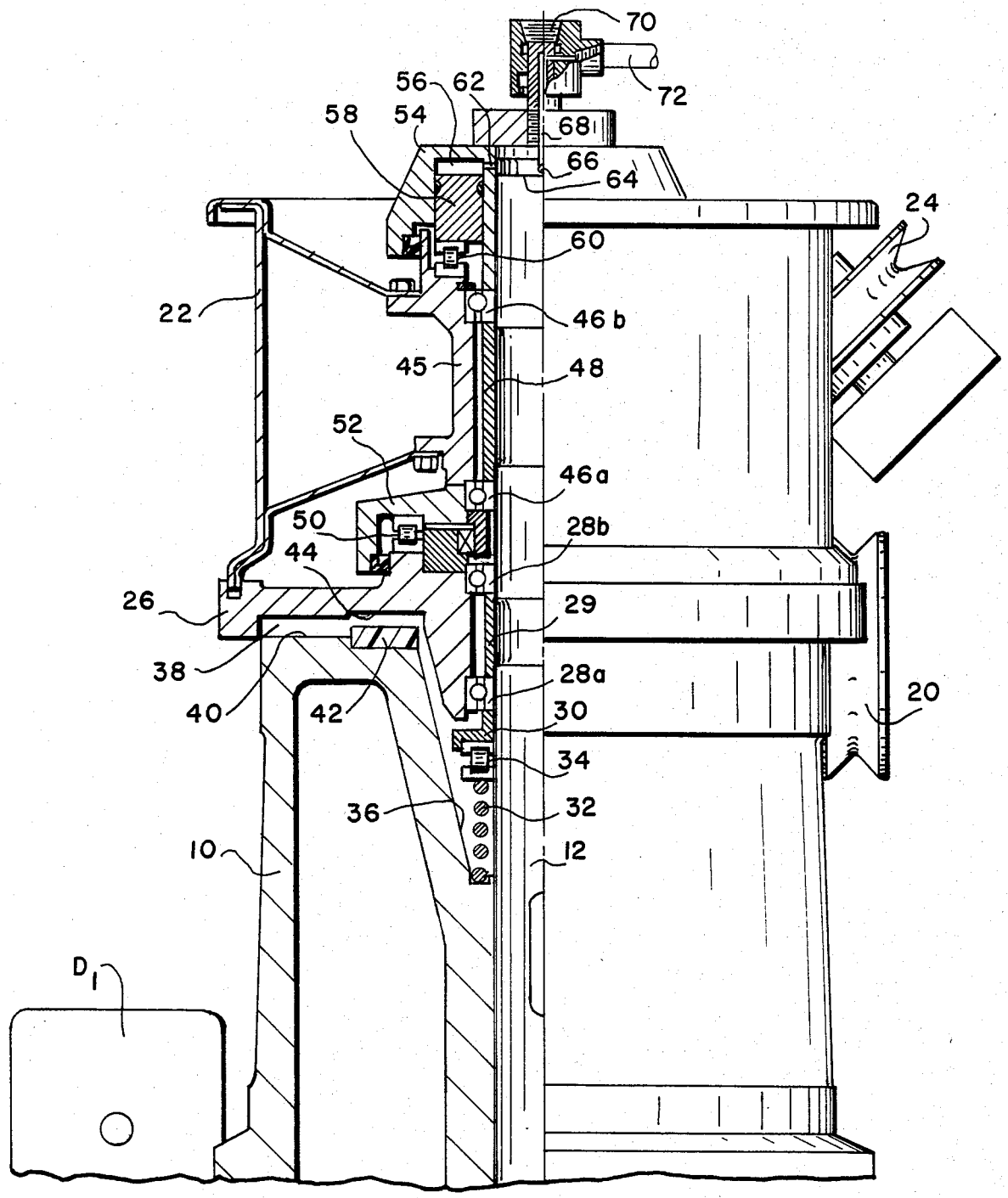
FIG. 2 is a partial cross-sectional and side-elevational view of the upper and lower blocks and spinner at one of the machine stations.

Referring now to FIG. 2, it will be seen that the lower block 10 is mounted on the drive shaft 12 for rotation therewith, there being a key or other equivalent connection (not shown) being provided therebetween. A spinner 26 is journalled for rotation on the shaft 12 by means of a pair of roller bearings 28*a*, 28*b*. The roller bearings 28*a*, 28*b* are axially separated by a sleeve 29 which is free to slide axially along with the inner bearing races on shaft 12. The inner race of the lower roller bearing 28*a* rests against a flanged collar 30 which is axially movable on the shaft and acted upon by a coiled spring 32 via a thrust bearing 34. The bottom of the spring is seated at the base of a notch 36 in the lower block 10. The spring 32 acts as a separating means for yieldably urging the spinner 26 axially away from the lower block 10 to maintain a spacing therebetween as at 38. The upper face 40 of the lower block 10 carries a replaceable brake shoe 42 which is opposed by a contact face 44 on the underside of the spinner 26. If desired, it would of course be possible to reverse the relative positions of the brake shoe 42 and contact face 44, i.e., to mount the brake shoe on the underside of the spinner and to locate the contact face on the top of the lower drum. The transfer sheave 20 is mounted in a known manner on the spinner 26 for rotation therewith.

The inner hub 45 of the upper block 22 is journalled for rotation on the drive shaft 12 by means of a pair of roller bearings 46*a*, 46*b* which are axially separated by a sleeve 48. The inner races of the roller bearings 46*a*, 46*b* and the intermediate sleeve 48 also are free to slide axially on the drive shaft. A thrust bearing 50 is interposed between the spinner 26 and a skirt 52 on the inner hub 45 of the upper block 22.

A cylinder head 54 is mounted to the upper end of the drive shaft 12. The cylinder head defines an annular cylinder chamber 56 containing an annular piston 58. A thrust bearing 60 is interposed between the lower end of the piston 58 and the inner hub 45 of the upper block 22. The cylinder chamber 56 communicates via a radial passageway 62 with a circumferential groove 64 in the drive shaft 12. The drive shaft groove 64 in turn communicates via a radial bore 66 with an axial passageway 68. Passageway 68 communicates with a conventional rotary coupling 70 connected to a conduit 72. A suitable control medium, for example compressed air received from a remotely located valve at a central control panel, may be applied via conduit 72, coupling 70, and the communicating passageways 68, 66, 64 and 62 to the cylinder chamber 56, thereby urging the piston 58 downwardly with a force adequate to overcome the opposing force of spring 32. This will result in the upper block 22 and the spinner 26 being shifted downwardly to bring the spinner's face 44 into frictional contact with the brake shoe 42 on the lower drum 10. When this occurs, the spinner will be driven by the lower drum, with the drive force being proportional to the force being exerted by the piston 58. However, the upper drum 22 will continue to rotate freely with respect to the spinner 26 and piston 58 because of the interposition of thrust bearings 50, 60 respectively therebetween.

In light of the foregoing, it will be appreciated that the driving force being imparted to the spinner 26 by the lower drum 10 can be controlled by varying the force being exerted by piston 58. This can be accomplished while the machine is in operation, and from a remote control location. The brake shoe 42, spring 32, piston 58, and other associated components all are positioned at locations which are not exposed to damage in the event of a wire break. Thus, the present invention represents a marked improvement over the arrangements conventionally employed to drive the spinners.

I claim:

1. In a wire drawing machine having at least one station with a rotatably driven shaft on which are arranged upper and lower blocks and an associated spinner carrying a transfer sheave, the upper block and spinner being rotatable relative to each other on said shaft and the lower block being driven by said shaft to draw wire through a die, the thus drawn wire being temporarily accumulated as a plurality of windings on the driven lower block before passing via the transfer sheave to the upper block where the wire is again temporarily accumulated as a plurality of windings before leaving the station, the improvement comprising: means for mounting the spinner for axial movement on said shaft in relation to the lower block; separating means for yieldably urging the spinner axially away from the lower block to maintain a spacing therebetween; and control means acting in opposition to the separating means to axially urge the spinner into contact with the lower block, thereby causing the spinner to be frictionally driven by the lower block.

2. The wire drawing machine of claim 1 further comprising means for connecting the upper block to the spinner for axial movement therewith in relation to the shaft and the lower block.

3. The wire drawing machine of claim 2 wherein the control means is arranged on said shaft to act on the spinner via the upper block.

4. The wire drawing machine of claim 3 wherein said control means comprises an annular cylinder carried by the shaft for rotation therewith, an annular axially displaceable piston contained in the cylinder and arranged to act via a thrust bearing on the upper block, and means for introducing a pressurized medium into the cylinder to axially displace the piston.

5. The wire drawing machine of claim 4 wherein the separating means comprises a compression spring surrounding the drive shaft.

6. The wire drawing machine of claim 1 wherein one of said spinner and said lower block is provided with a replaceable brake shoe adapted to frictionally contact an axially opposed face on the other of said spinner and lower block.

7. In a wire drawing machine having at least one station with a rotatably driven shaft on which are arranged upper and lower blocks and an associated spinner carrying a transfer sheave, the upper block and spinner being rotatable relative to each other on said shaft and the lower block being driven by said shaft to draw wire through a die, the thus drawn wire being temporarily accumulated as a plurality of windings on the driven lower block before passing via the transfer sheave to the upper block where the wire is again temporarily accumulated as a plurality of windings before leaving the station, the improvement comprising: means for permitting the spinner and the upper block to shift axially along said shaft in relation to said lower block; resilient separating means for urging the spinner away from the lower block to yieldably maintain a spacing therebetween; and remotely operable control means acting through said upper block in opposition to said separating means to urge the spinner into frictional contact with the lower block, thereby causing the spinner to be frictionally driven by the lower block.

* * * * *